US010779367B2

(12) United States Patent
Rogover

(10) Patent No.: US 10,779,367 B2
(45) Date of Patent: Sep. 15, 2020

(54) LED LIGHTING AND ALERT SYSTEM

(71) Applicant: Daniel Rogover, Hollywood, FL (US)

(72) Inventor: Daniel Rogover, Hollywood, FL (US)

( * ) Notice: Subject to any disclaimer, the term of this patent is extended or adjusted under 35 U.S.C. 154(b) by 0 days.

(21) Appl. No.: 16/413,949

(22) Filed: May 16, 2019

(65) Prior Publication Data

US 2019/0357328 A1 Nov. 21, 2019

Related U.S. Application Data

(60) Provisional application No. 62/672,762, filed on May 17, 2018.

(51) Int. Cl.

| | |
|---|---|
| ***H05B 45/10*** | (2020.01) |
| ***G08B 21/02*** | (2006.01) |
| ***G09G 3/32*** | (2016.01) |
| ***A61G 5/04*** | (2013.01) |
| ***G09F 9/33*** | (2006.01) |
| ***G08B 3/10*** | (2006.01) |
| ***H05B 47/19*** | (2020.01) |

(52) U.S. Cl.

CPC ..... *H05B 45/10* (2020.01); *A61G 5/04* (2013.01); *G08B 3/10* (2013.01); *G08B 21/02* (2013.01); *G09F 9/33* (2013.01); *H05B 47/19* (2020.01)

(58) Field of Classification Search

CPC .... H05B 33/08; H05B 33/0845; H05B 37/02; H05B 37/0272; H05B 45/10; H05B 47/19; G08B 21/02; G08B 3/00; G08B 3/10; G09G 3/32; G09G 3/33; A61G 5/04

See application file for complete search history.

(56) References Cited

U.S. PATENT DOCUMENTS

| | | | | |
|---|---|---|---|---|
| 5,056,545 A * | 10/1991 | Spaeth | A45B 1/00 135/66 |
| 7,951,045 B1 * | 5/2011 | Brader | A63B 24/0062 482/3 |
| 2002/0105432 A1 * | 8/2002 | Pederson | B60Q 1/2611 340/815.45 |
| 2007/0000531 A1 * | 1/2007 | Russo | A45B 3/00 135/66 |
| 2014/0268882 A1 * | 9/2014 | Hoang | F21S 8/035 362/642 |

* cited by examiner

*Primary Examiner* — Thai Pham

(74) *Attorney, Agent, or Firm* — 21st Century IP LLC; Kelly Hollowell

(57) ABSTRACT

Disclosed is an alert system to heighten visibility of a transport unit. The alert system includes a control box, a light emitting diode (LED) matrix operably connected to the control box, a plurality of LED strips operably connected to the control box, and a battery operably connected to the control box, the LED strips and the LED matrix. The control box includes a memory unit operably connected to a processing unit enabled to store display patterns and at least one LED button operably connected to at least one LED strip. The processing unit operably connected to at least one LED matrix button operably connected to the LED matrix to display at least one of the display patterns. The alert system is attached to a transport unit.

20 Claims, 6 Drawing Sheets

LED LIGHTING AND ALERT SYSTEM

CROSS-REFERENCE TO RELATED APPLICATION

This application claims priority to a U.S. Provisional Application No. 62/672,762 filed on May 17, 2018, the entire contents of which are incorporated herein by references in its entirety.

BACKGROUND OF THE INVENTION

1. Field of Invention

The present invention generally relates to a light emitting diode ("LED") lighting and alert system and more particularly to an LED lighting and alert system attached to a transport unit for displaying lighting and sound for heightened user awareness, visibility and entertainment.

2. Description of Related Art

Various transport units such as wheeled carts, wheelchairs and walkers are known in the art to provide improved mobility for users and/or increase the payload an individual can transport at any given time. Various types of transport units are known and available on the market with a variety of features designed to meet individual needs. What is not known are mobility and/or carry devices ("transport units") that are adapted with safety features such as sound and lighting systems to provide heightened awareness and visibility of these devices and therefore the users. For example, an encumbered or disabled person maybe prone to accidents due to compromised mobility and/or low visibility at night.

What is needed is a device having an alert system operably connected to a transport unit to provide heightened visibility with an ability to display messages and sounds. The device should be easy to use, configurable and programmable to display messages and sounds of the user's choice. Furthermore, the device should be able to receive commands to wirelessly control these safety and entertaining features. This system and device may be used as a beacon for the user day or night. It can be used for entertainment. It may also be a user's unique identifier to designate ownership of the transport unit.

SUMMARY OF THE INVENTION

In accordance with teachings of the present invention an alert system attached to a transport unit is provided. Herein described is an alert system configured to attach with a transport unit to provide heightened visibility with an ability to display messages and sounds, while still retaining the advantages that transport unit provide. The alert system includes a battery affixed to a standard transport unit.

In one embodiment, the present invention provides an alert system having a control box, a light emitting diode (LED) matrix operably connected to the control box, and a plurality of LED strips operably connected to the control box. The battery is operably connected to the control box, the LED strips and the LED matrix. The control box is having a memory unit operably connected to a processing unit enabled to store display patterns, at least one LED button operably connected to at least one LED strip, and at least one LED matrix button operably connected to the processing unit and the LED matrix to display at least one of the display patterns.

In one embodiment, the present invention provides at least one battery control button, and the processing unit is operably connected to an LED strip speed-control switch, an LED matrix speed-control switch, an LED matrix brightness-control switch and an LED strip brightness-control switch.

In one embodiment, the present invention provides a battery level indicator operably connected to the battery, at least one LED project box operably connected to the control box and the LED project box is attached to a frame of the transport unit, and a speaker operably connected to the control box and wherein the memory unit further stores sound signals.

In one embodiment, the present invention provides at least one HORN button operably connected to the speaker to generate at least one sound signal, a volume switch to control volume of the sound signals, a second control box configured on the frame of the transport unit, the second control box comprising plurality of HORN buttons. Each HORN button is operably connected to the speaker to generate at least one sound signal.

In one embodiment, the present invention provides a wireless receiving unit operably connected to the processing unit. The LED strips includes LED lights (about 450-500 individual LED; 12-14 meters of lights in length; multi strands connected or single stranded) with standard electrical connection to microcontrollers to control patterns and speed of multiple light displays and matrix with scrolling text using open source coding.

DETAILED DESCRIPTION OF DRAWINGS

While various embodiments of the present disclosure are disclosed, it should be understood that they are presented as examples only, and are not intended to be limiting. Similarly, the drawings and diagrams depict structural or architectural examples or alternate configurations of the invention, which are provided to aid in understanding the features and functionality of the various embodiments of the invention but are not intended to be limiting. The embodiments and features may be implemented and/or altered in a variety of ways known to those of ordinary skill the art.

Figure 1:
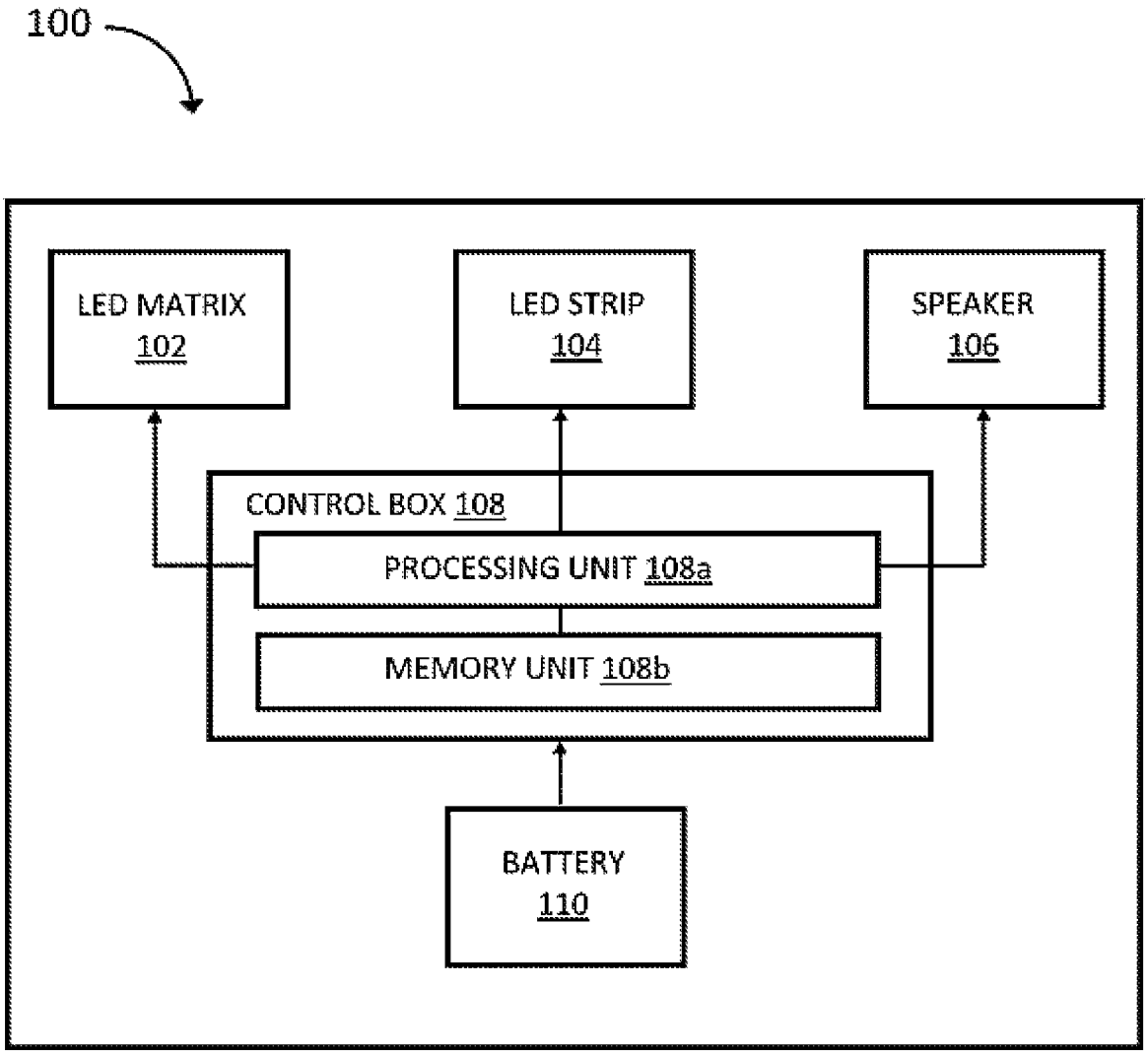
FIG. 1 illustrates a block diagram of an alert system in accordance with a preferred embodiment of the present invention.

FIG. 1 illustrates a block diagram of an alert system 100 in accordance with a preferred embodiment of the present invention. The alert system 100 includes a LED matrix 102, a plurality of LED strip 104, a control box 108 and a battery 110. In another embodiment of the present invention, the alert system 100 further includes a speaker 106 operably connected to the control box 108.

The LED matrix 102 is operably connected to the control box 108. The LED matrix 102 is explained in detail in conjunction with FIG. 2 of the present invention. The LED strips 104 are operably connected to the control box 108. The LED strips 104 are explained in detail in conjunction with FIG. 2, FIG. 3 and FIG. 6 of the present invention. The speaker 106 is operably connected to the control box 108. The speaker 106 and the control box 108 are explained in detail in conjunction with FIG. 3 and FIG. 4-5 respectively of the present invention.

The battery 110 is attached to the transport unit (shown in FIG. 2) to power the control box 108, the speaker 106, the LED strips 104 and the LED matrix 102. Examples of the battery 110 include but not limited to Lithium-ion (Li-ion), Nickel Cadmium (Ni—Cd), Nickel-Metal Hydride (Ni-MH), and Lead-Acid. In an embodiment of the present invention, the battery 110 is a 4.8V 2000 mAh Battery.

Figure 2:
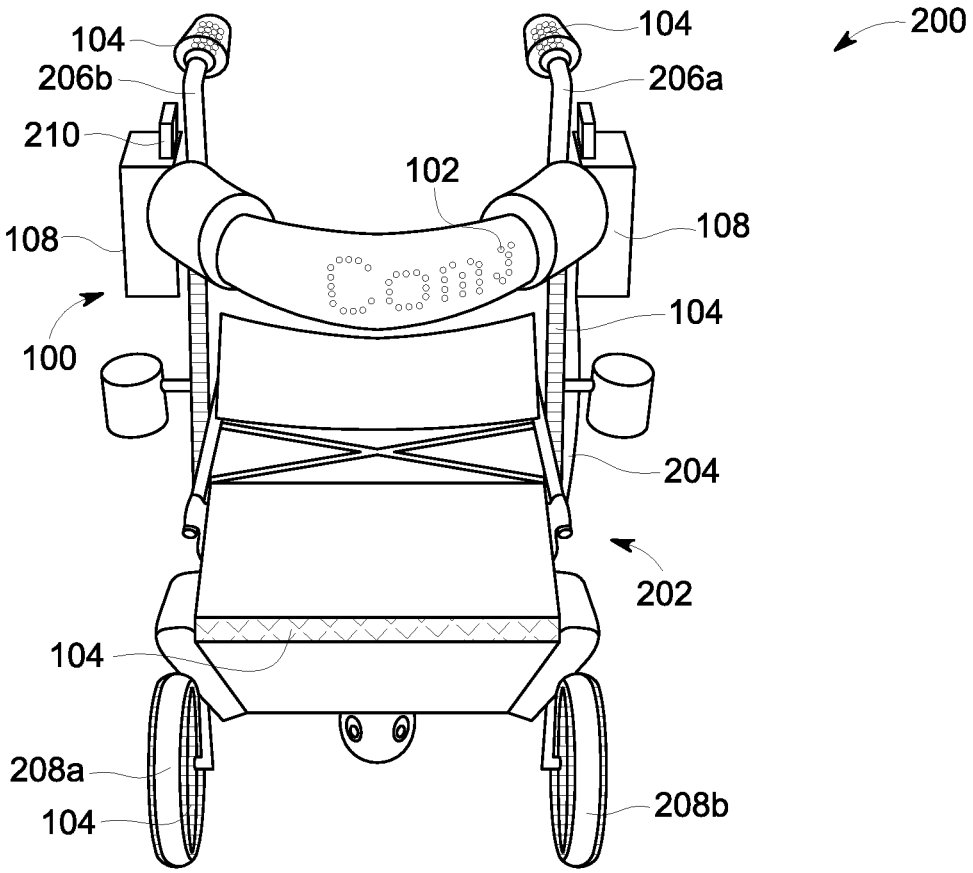
FIG. 2 illustrates a front view of a device attached to a transport unit in accordance with another embodiment of the present invention.

FIG. 2 illustrates a front view of a device 200 attached to a transport unit 202 in accordance with another embodiment of the present invention. The transport unit 202 includes a frame 204. In another embodiment of the present invention, the transport unit 202 also includes handles 206*a*, 206*b* and wheels 208*a*, 208*b*.

In an embodiment of the present invention, the transport unit 202 is a wheeled mobility device such as but not limited to a wheelchair, stroller, walker, cart, tricycle, baby carriage, beach buggy, sport buggy, grocery cart etc.; as each may be envisioned without deviating from the scope of the present invention.

In an embodiment of the present invention, the LED matrix 102 is configured between pair of handles 206*a*, 206*b*. The LED matrix 102 displays a pattern. The pattern may be scrolled on continuous loop. The pattern may be displayed in various colors such as RED, GREEN, YELLOW, VIOLET, BLUE, etc. It would be readily apparent to those skilled in the art that various colors may be used to display pattern without deviating from the scope of the present invention.

As shown in FIG. 1, the LED matrix 102 displays a pattern 'COM 1'. However, it would be readily apparent to those skilled in the art that various types of pattern such as 'Show Me the Money', 'I Came Here to Win', 'I'm Here to Party', 'SOON', 'HELP', 'Turning Left', Turning Right' and various other short phrases may be displayed. In an embodiment of the present invention, the LED matrix 102 is 8×32 neopixel RGB LED Matrix. The LED matrix 102 generally contains between 200 to 300 individual LED's depending upon the size of the transport unit 202 and on the requirement to display the patterns. Thus patterns may be word, image, special characters, number or a combination of these display modes.

In one embodiment, the LED strips 104 are attached to the handle 206*a*, 206*b*, the frame 204, and the wheels 208*a*, 208*b* of the transport unit 202. The LED strips 104 are used to heighten visibility of the device 200 and provide heightened visibility to the user. In the later, that is both the ability to see and be seen by others. In addition, the control box 108 controls illumination of the LED strips 104.

The LED strips 104 are between 450-500 individual LED's and approximately 12-14 meters of lights in length. It would be readily apparent to those skilled in the art that the LED strips 104 may be attached to various parts of the transport unit 202 to increase visibility.

In another embodiment of the present invention, the alert system 100 further includes at least one control button 210 to control supply of power from battery 110 (shown in FIG. 1) to operate the control box 108. The control button 210 is on-off button. However, it would be readily apparent to those skilled in the art various types of control button 210 such as a rotatable or flip switch may be envisioned without deviating from the scope of the present invention.

Figure 3:
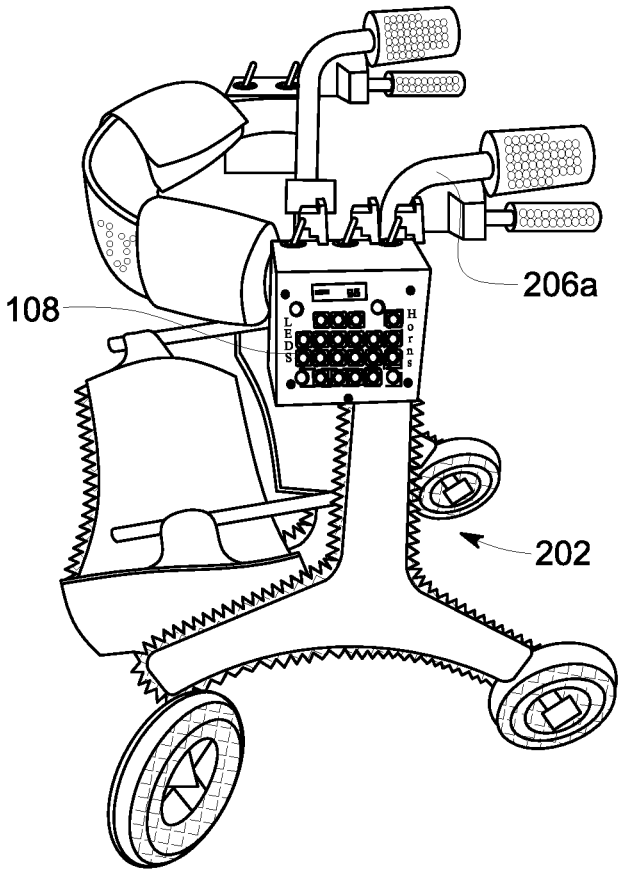
FIG. 3 illustrates a side perspective view of the transport unit showing position of a control box in accordance with a preferred embodiment of the present invention.

FIG. 3 illustrates a side perspective view of the transport unit 202 showing position of the control box 108 in accordance with an embodiment of the present invention. The control box 108 is attached on side of the frame 204 (shown in FIG. 2) near to the handle 206*a* to allow a user to easily operate control buttons (shown in FIG. 4 and FIG. 5). The control box 108 is explained in detail in conjunction with FIG. 4 and FIG. 5 of the present invention.

Figure 4:
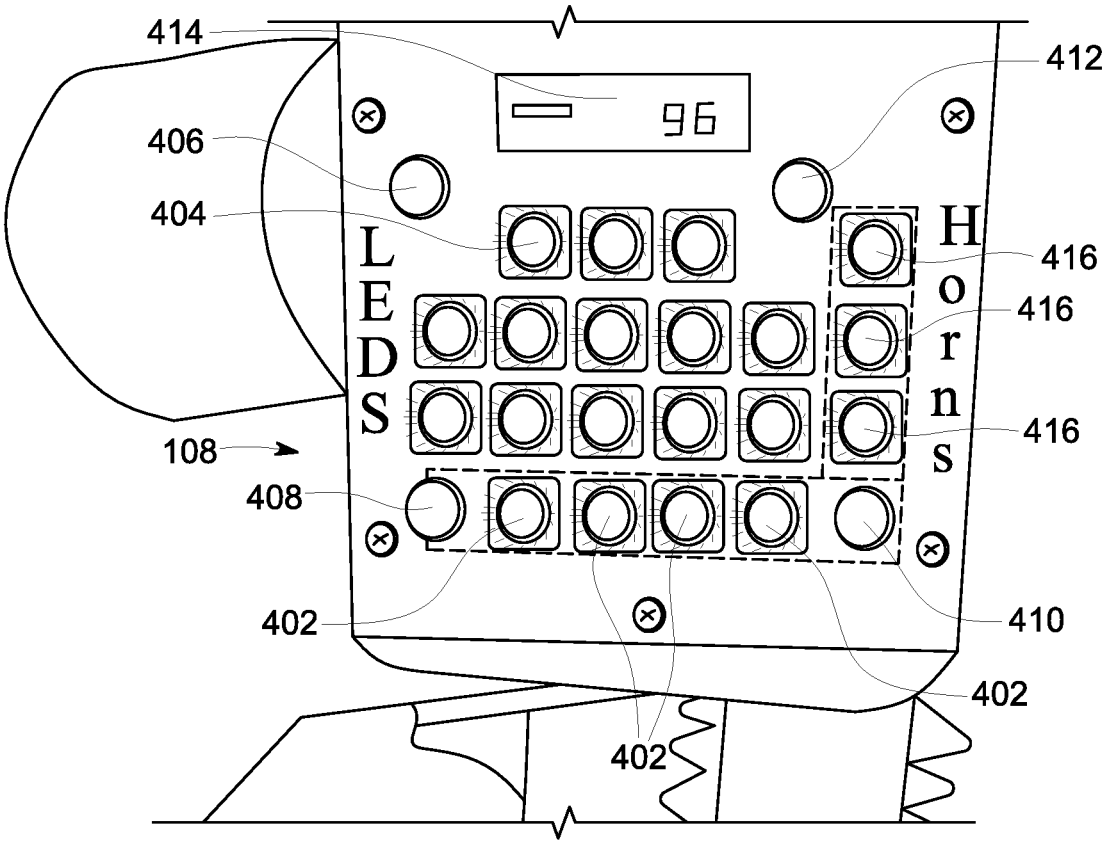
FIG. 4 illustrates a front view of the control box in accordance with an embodiment of the present invention.

FIG. 4 illustrates a front view of the control box 108 in accordance with an embodiment of the present invention. The control box 108 includes the memory unit 108*b* (shown in FIG. 1 to store display patterns, at least one LED matrix button 402 operably connected to the LED matrix 102 to display at least one of the display patterns, the processing unit 108*a* (shown in FIG. 1) to control the operation of the LED matrix button 402, and at least one LED button 404 to operate at least one LED strip 104 (shown in FIG. 2). The LED matrix button 402 and the LED button 404 are push buttons. In one embodiment, the button 402 and the button 404 are LED illuminated.

In one embodiment, one LED button 404 is enabled to operate all LED strips 104 using successive compressions of the LED button 404. In another embodiment, there are multiple LED buttons 404 in which each LED button 404 is enabled to operate at least one specifically designated LED strip 104 (shown in FIG. 2). For exemplary purposes, one LED button 404 is used to operate the LED strip attached to the wheels; another LED button 404 is used to operate the LED strip attached to the handles etc. Further, the LED button 404 may be used to operate a specific color such as but not limited to RED or Green or Blue LED light strips.

In one embodiment of the present invention, the number of LED button 404 is 13 and the number of LED matrix button 402 is 4. It would be readily apparent to those skilled in the art that various number of LED button 404 and button 402 may be envisioned without deviating from the scope of the present invention.

It would be readily apparent to those skilled in the art that number of LED button 404 depending upon the number of LED strips and color of the LED strips may be envisioned without deviating from the scope of the present invention. The LED matrix button 402 is used to operate stored display patterns in which selection of the display patterns are by successive compressions of a single LED matrix button 402. In another embodiment, one of the LED matrix buttons 402 displays one specific pattern and other LED matrix button 402 displays another specific pattern. Examples of the LED matrix pattern are explained in detail in conjunction with FIG. 1 of the present invention.

Examples of the memory unit 108*b* (shown in FIG. 1) include but are not limited to RAM, ROM, CMOS, flash, etc. which are known to those of ordinary skill in the art. In one embodiment of the present invention, the processing unit 108*a* (shown in FIG. 1) is Arduino Uno REV3 coupled with Adafruit WINC1500 WiFi Shield. It would, however, be readily apparent to those skilled in the art that various processing unit may be envisioned without deviating from the scope of the present invention.

In another embodiment of the present invention, the control box 108 further includes a LED strip speed switch 406 to control speed of illumination of the LED strips 104

(shown in FIG. 2), a LED matrix speed switch 408 to control speed of illumination of the LED matrix 102 (shown in FIG. 2), a LED matrix brightness switch 410 to control the brightness of the illumination of the LED matrix (shown in FIG. 2), and the LED strip brightness switch 412 to control the brightness of the illumination of the LED strips (shown in FIG. 2).

In one embodiment, the switch 406, the switch 408, the switch 410 and the switch 412 are rotatable switches. It would be readily apparent to those skilled in the art that various types of switches 406-412 such as multi-push switches, multi-rotation switches having potentiometer may be envisioned without deviating from the scope of the present invention.

In another embodiment of the present invention, the control box 108 further includes a battery level indicator 414 to display status of battery power. In an exemplary embodiment of the present invention, the battery level indicator is an LED display. However, it would be readily apparent to those skilled in the art that various types of battery level indicator 414 may be envisioned without deviating from the scope of the present invention.

In another embodiment of the present invention, the control box 108 further includes at least one HORN button 416 operably connected to the speaker 106 (shown in FIG. 1). Each Horn button 416 represents a sound signal. The sound signals are generated through the speaker 106. The control box 108 further includes a volume switch (not shown in FIGURES) to control volume of the sound signals. In one embodiment of the present invention, the number of HORN buttons 416 is 3.

In another embodiment of the present invention, the control box 108 further includes a wireless receiving unit (not shown in FIGURES) operably connected to the processing unit (not shown in FIGURES). The wireless receiving unit receives command over a communication network. Examples of the wireless receiving unit includes but not limited to Bluetooth, Wi-Fi unit, NFC unit, cellular unit etc. In one embodiment of the present invention, the wireless receiving unit is Arduino Uno REV3. However, it would be readily apparent to those skilled in the art that various types of wireless receiving unit may be envisioned without deviating from the scope of the present invention.

For exemplary purposes, the control box 108 is operably connected to a smart device (such as smartphone, IPAD etc.) to receive commands wirelessly. A user input a command (e.g. HELP), the control box 108 receives the command through the wireless receiving unit and instructs the LED matrix to display/scroll HELP. Similarly, a user is able to display any other commands/instructions through the LED Matrix and is able to operate and LED strip wirelessly.

Figure 5:
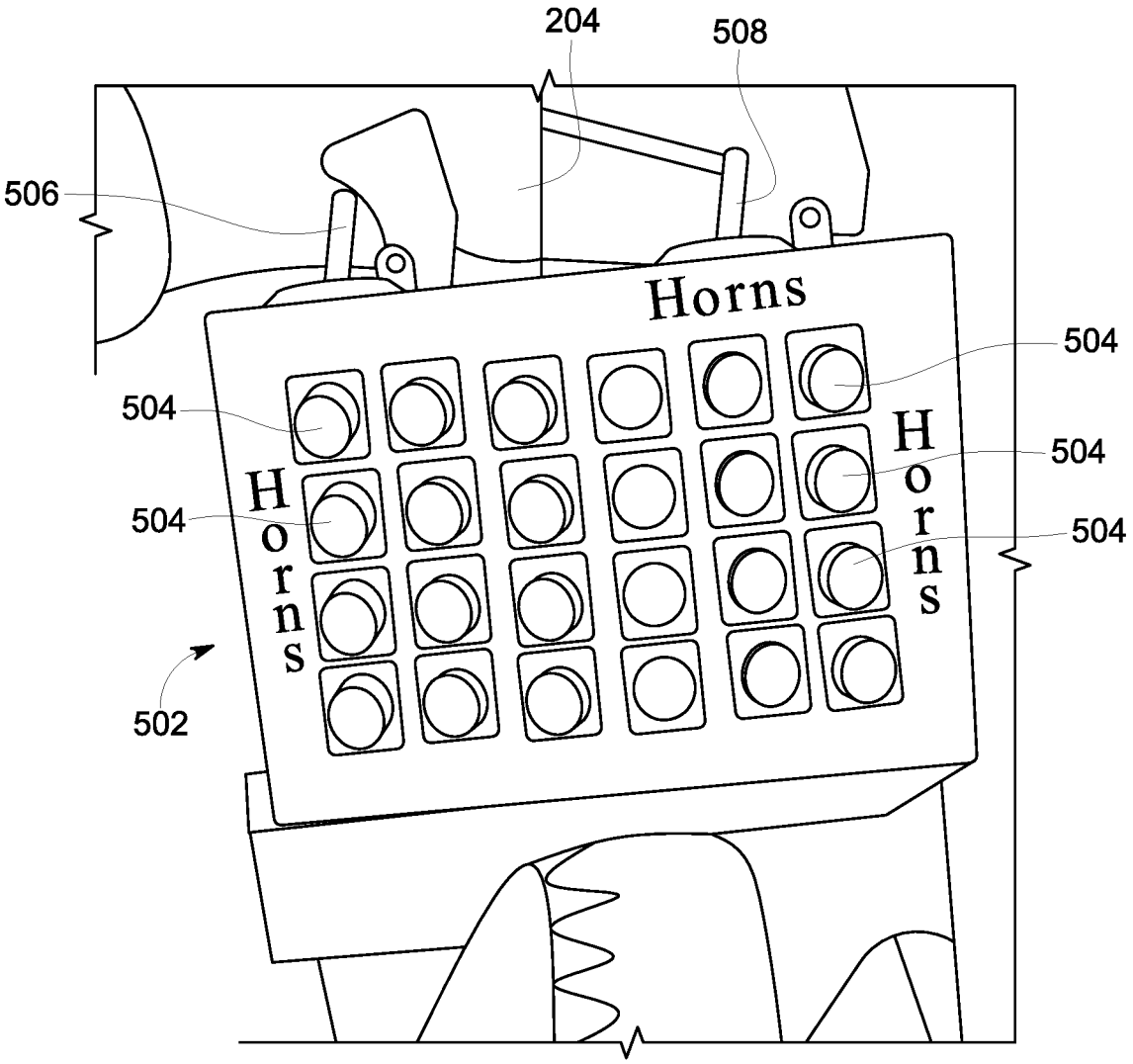
FIG. 5 illustrates a front view of a second control box in accordance with an embodiment of the present invention.

FIG. 5 illustrates a front view of a second control box 502 in accordance with an embodiment of the present invention. The second control box 502 is configured on the frame 204 of the transport unit 202 (shown in FIG. 2). The second control box 502 includes plurality of Horn buttons 504 operably connected to the speaker 106 (shown in FIG. 1).

Each HORN button 504 generates one sound signal through the speaker 106 (shown in FIG. 1). In an embodiment of the present invention, the number of HORN buttons 504 is 18. Hence, each HORN button produce different sound signal. The second control box 502 is able to generate 18 different sounds through the speaker. Examples of sound signal include but not limited to HELP, EMERGENCY, animal sounds, bird sounds, songs, music etc.

The alert system 100 (shown in FIG. 1) further includes a switch 506 and a switch 508 operably connected to the battery. The switch 506 is to on-off the second control box 502. The switch 508 is to on-off the illumination of the HORN buttons 504. The HORN buttons 504 are illuminated Push buttons. However, it would be readily apparent those skilled in the art that various number and types of HORN buttons such as switch may be used without deviating from the scope of the present invention.

Figure 6:
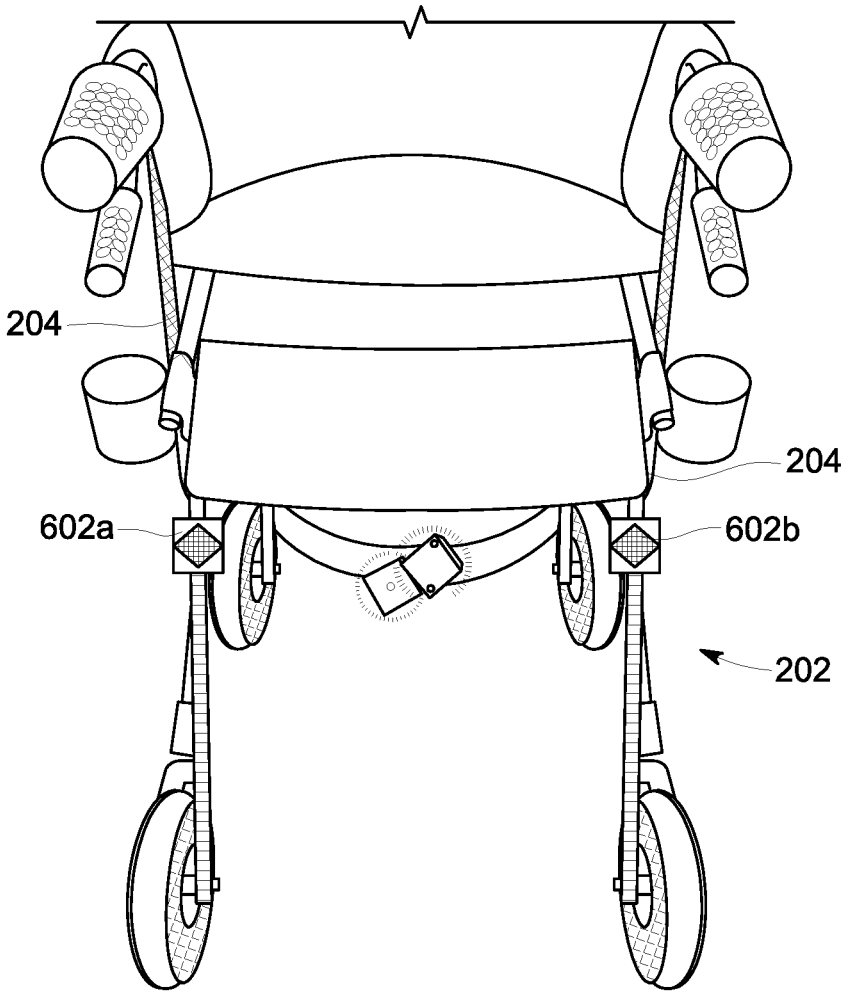
FIG. 6 illustrates a rear view of the transport unit showing LED project boxes in accordance with another embodiment of the present invention.

FIG. 6 illustrates a rear view of the transport unit 202 showing LED project box 602*a*, 602*b* in accordance with another embodiment of the present invention. The alert system 100 further includes LED project box 602*a*, 602*b* attached to the frame 204 of transport unit 202 to operably connect with the control box 108 (shown in FIG. 3).

The LED project box 602*a*, 602*b* includes plurality of LEDs to display various signals such as direction signals, tail lights, fog lights, reverse indication, emergency signal etc. to approaching vehicles and human traffic. The LED project box 602*a*, 602*b* are configured to receive commands from the control box 108 (shown in FIG. 3). In an embodiment of the present invention, the LED project box 602*a*, 602*b* receives command wirelessly from the control box 108 (shown in FIG. 3).

In the foregoing description, it will be readily appreciated by those skilled in the art that modifications may be made to the invention without departing from the concepts disclosed herein. Such modifications are to be considered as included in the following claims, unless the claims by their language expressly state otherwise.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future.

Likewise, where this document refers to technologies that would be apparent or known to one of ordinary skill in the art, such technologies encompass those apparent or known to the skilled artisan now or at any time in the future. Furthermore, the use of plurals can also refer to the singular, including without limitation when a term refers to one or more of a particular item; likewise, the use of a singular term can also include the plural, unless the context dictates otherwise.

The presence of broadening words and phrases such as "one or more," "at least," "but not limited to" or other like phrases in some instances shall not be read to mean that the narrower case is intended or required in instances where such broadening phrases may be absent. Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not such embodiments are described and whether or not such features are presented as being a part of a described embodiment. Thus, the breadth and scope of the present invention should not be limited by any of the above-described exemplary embodiments.

What is claimed is:

1. A mobility device alert system comprising:

a frame connected to at least two handles and at least two wheels;

a control box attached to one of the two handles;

a light emitting diode (LED) matrix operably connected to the control box, said LED matrix configured between the at least two handles to display patterns comprising short phrases using LEDs;

a plurality of LED strips attached to the mobility device and operably connected to the control box; and a battery operably connected to the control box, the LED strips and the LED matrix;

the control box comprising:

a memory unit operably connected to a processing unit enabled to store display patterns;

the processing unit operably connected to at least one LED matrix button operably connected to the LED matrix to display at least one of the display patterns; and at least one LED button operably connected to at least one LED strip to display at least one of the display patterns.

2. The mobility device alert system according to claim 1, further comprising at least one battery control button.

3. The control box according to claim 1 further comprising: an LED strip speed-control switch operably connected to the processing unit; an LED matrix speed-control switch operably connected to the processing unit; an LED matrix brightness-control switch operably connected to the processing unit; and an LED strip brightness-control switch operably connected to the processing unit.

4. The control box according to claim 1, further comprising a battery level indicator operably connected to the battery.

5. The mobility device alert system according to claim 1 further comprising at least one LED project box operably connected to the control box and the LED project box is attached to the frame.

6. The mobility device alert system according to claim 1 further comprising a speaker operably connected to the control box and wherein the memory unit further stores sound signals.

7. The mobility device alert system according to claim 6, wherein the control box further comprises:

at least one HORN button operably connected to the speaker to generate at least one sound signal; and a volume switch to control volume of the sound signals.

8. The mobility device alert system according to claim 7 further comprising a second control box configured on the frame, the second control box comprising plurality of HORN buttons, wherein each HORN button is operably connected to the speaker to generate at least one sound signal.

9. The control box according to claim 1 further comprising a wireless receiving unit operably connected to the processing unit.

10. The LED strip according to claim 1, comprising between 400-500 individual LED lights.

11. The LED strip according to claim 1, further comprising between 12-14 meters of lights in length.

12. The mobility device alert system according to claim 1, wherein the mobility device further comprises a wheelchair.

13. The mobility device alert system according to claim 1, wherein the mobility device further comprises a stroller.

14. The mobility device alert system according to claim 1, wherein the mobility device further comprises a walker.

15. The mobility device alert system according to claim 1, wherein the mobility device further comprises a cart.

16. The mobility device alert system according to claim 1, wherein the mobility device further comprises a tricycle.

17. The mobility device alert system according to claim 1, wherein the mobility device further comprises a baby carriage.

18. The mobility device alert system according to claim 1, wherein the mobility device further comprises a beach buggy.

19. The mobility device alert system according to claim 1, wherein the mobility device further comprises a sport buggy.

20. The mobility device alert system according to claim 1, wherein the mobility device further comprises a grocery cart.

* * * * *